US010578290B2

(12) United States Patent
Zheng et al.

(10) Patent No.: US 10,578,290 B2
(45) Date of Patent: Mar. 3, 2020

(54) LED SPOT LAMP WITH DOUBLE SIDES EMITTING LIGHT

(71) Applicant: ZHEJIANG NVC LAMPS CO., LTD, Zhejiang (CN)

(72) Inventors: Xiaorong Zheng, Zhejiang (CN); Renyan Zhan, Zhejiang (CN)

(73) Assignee: ZHEJIANG NVC LAMPS CO., LTD, Zhejiang (CN)

( * ) Notice: Subject to any disclaimer, the term of this patent is extended or adjusted under 35 U.S.C. 154(b) by 194 days.

(21) Appl. No.: 15/854,758

(22) Filed: Dec. 27, 2017

(65) Prior Publication Data

US 2018/0180272 A1 Jun. 28, 2018

(30) Foreign Application Priority Data

Dec. 27, 2016 (CN) ..... 2016 1 1222387

(51) Int. Cl.

| | |
|---|---|
| ***F21K 9/233*** | (2016.01) |
| ***F21V 23/00*** | (2015.01) |
| ***F21V 3/00*** | (2015.01) |
| ***F21V 29/90*** | (2015.01) |
| ***F21V 23/06*** | (2006.01) |
| ***F21V 29/70*** | (2015.01) |
| *F21Y 115/10* | (2016.01) |

(Continued)

(52) U.S. Cl.

CPC ..... *F21V 23/005* (2013.01); *F21K 9/233* (2016.08); *F21V 3/00* (2013.01); *F21V 23/06* (2013.01); *F21V 29/70* (2015.01); *F21V 29/90* (2015.01); *F21Y 2107/90* (2016.08); *F21Y 2115/10* (2016.08); *F28D 2021/0029* (2013.01)

(58) Field of Classification Search

CPC ..... F21K 9/00; F21K 9/20; F21K 9/23; F21K 9/232; F21K 9/233; F21K 9/235; F21K 9/237; F21K 9/238; F21K 9/27; F21K 9/272; F21K 9/275; F21K 9/278; F21K 99/00; F21S 2/00; F21S 6/008; F21Y 2107/90; F21V 23/001–009; F21V 23/06; F21V 29/00; F21V 29/70; F21V 29/90; F21V 29/506; F21V 3/00

See application file for complete search history.

(56) References Cited

U.S. PATENT DOCUMENTS

2012/0140466 A1* 6/2012 Yang ..... F21V 7/0008 362/235
2013/0279164 A1* 10/2013 Hsu ..... F21V 7/0058 362/235
2018/0175264 A1* 6/2018 Lee ..... H01L 33/60

* cited by examiner

*Primary Examiner* — Steven S Paik
*Assistant Examiner* — April A Taylor
(74) *Attorney, Agent, or Firm* — JCIPRNET

(57) ABSTRACT

An LED spot lamp with double sides emitting light including a lamp cap, a lamp cup with one end connected with the lamp cap together and a lens connected to the other end of the lamp cup is provided. A cavity is encircled by the lamp cup and the lens. An LED light source including a circuit board provided with LEDs and an LED driver for driving the LEDs to emit light, and a radiator supporting the circuit board and dissipating heat generated by the LEDs are arranged in the cavity. The circuit board includes a main light emitting plate irradiating the lens, and an auxiliary light emitting plate irradiating the direction away from the lens. The lamp cup is of a light transmitting glass structure. The brightness of light emitted from the main light emitting plate is greater than that of light emitted from the auxiliary light emitting plate.

16 Claims, 3 Drawing Sheets

(51) Int. Cl.

| | |
|---|---|
| *F28D 21/00* | (2006.01) |
| *F21Y 107/90* | (2016.01) |

LED SPOT LAMP WITH DOUBLE SIDES EMITTING LIGHT

CROSS-REFERENCE TO RELATED APPLICATION

This application claims the priority benefit of China application serial no. 201611222387.0, filed on Dec. 27, 2016. The entirety of the above-mentioned patent application is hereby incorporated by reference herein and made a part of this specification.

BACKGROUND

Technical Field

The present invention relates to an LED spot lamp, particularly relates to an LED spot lamp with double sides emitting light, and belongs to the field of illumination.

Description of Related Art

LEDs are widely applied to lamps due to the advantages of small size, low power consumption, long service life, high brightness, environment friendliness, durability and the like.

An LED spot lamp structurally includes a lamp cap, a light cup shell, an LED light source and a radiator, wherein the lamp cap is used for being connected with a base to fix the spot lamp and introduce power; the light cup shell is used for being connected with the lamp cap together to form a cavity, and is of a light transmitting structure; the LED light source is provided with an LED driver and a circuit board provided with a plurality of LEDs, and the LED driver is used for receiving power introduced by the lamp cap and then driving the LEDs to emit light; and the radiator is used for supporting the circuit board and dissipating the heat generated by the LEDs.

The existing LED spot lamp has the following defects: the light source, which is only arranged on the side of the radiator away from the lamp cap, can only illuminate towards one direction, but cannot play a role in auxiliary illumination on the other side, so that a dark zone is produced on the back to affect the illumination effect when the LED spot lamp is used.

SUMMARY

The present invention intends to provide an LED spot lamp with double sides emitting light, which almost does not produce a dark zone on the back of the lamp in use, thereby solving the problem that the lamplight effect is affected due to the fact that a dark zone is produced on the back of the existing LED spot lamp.

The above technical problem is solved via the following technical solution: an LED spot lamp with double sides emitting light includes a lamp cap, a lamp cup with one end connected with the lamp cap together and a lens connected to the other end of the lamp cup, a cavity is encircled by the lamp cup and the lens, an LED light source and a radiator are arranged in the cavity, and the LED light source includes a circuit board provided with a plurality of LEDs and an LED driver for driving the LEDs to emit light; the radiator is used for supporting the circuit board and dissipating heat generated by the LEDs; the circuit board includes a main light emitting plate and an auxiliary light emitting plate, the main light emitting plate irradiates the lens, the auxiliary light emitting plate irradiates the direction away from the lens, the lamp cup is of a light transmitting glass structure, and the brightness of light emitted from the main light emitting plate is greater than that of light emitted from the auxiliary light emitting plate.

In the present invention, the light source is divided into two parts irradiating two directions and the lamp cup is designed into a glass structure, so that light can be emitted from the back of the spot lamp while the spot lamp irradiates as the existing spot lamp, and a dark zone is effectively avoided on the back of the lamp in use.

Preferably, a wick column is further arranged in the cavity, the wick column includes a shell of a glass structure and wick wires arranged in the shell in a penetrating manner and having bare structures, the glass shell is connected with the lamp cap or the lamp cup together, one end of the wick wires is electrically connected with the lamp cap, and the other end of the wick wires is connected with the circuit board to introduce power to the LED driver. The existing method, which introduces power via an electric wire provided with an insulating layer, may have great interference on the light emitted from the back of the spot lamp, whereas this structure can reduce the influence on the light emitted from the back.

Preferably, the wick wires are connected with the circuit board in a pluggable manner, thus facilitating assembly and disassembly.

Preferably, the radiator includes a cylindrical side wall and a bottom wall connected to the end of the side wall away from the lens, the main light emitting plate is arranged on the surface of one side of the bottom wall facing the lens, and the auxiliary light emitting plate is located on the surface of the other side of the bottom wall away from the lens. The heat dissipation effect is good.

Preferably, the main light emitting plate and the auxiliary light emitting plate are clamped together and held on the side wall, thus facilitating assembly.

Preferably, the side wall is bonded with the lamp cup together via a thermal conductive adhesive. The heat dissipation effect can be strengthened.

Preferably, the LED driver is arranged on the circuit board. The compactness of the structure can be improved.

Preferably, the LED driver is arranged on the auxiliary light emitting plate. The illumination effect is good.

Preferably, the lens is provided with a condensing pit on the surface facing the radiator, and the LEDs on the main light emitting plate are aligned with the condensing pit. The irradiation effect of light emitted from the spot lamp can be improved.

Preferably, the brightness of light emitted from the main light emitting plate is greater than that of light emitted from the auxiliary light emitting plate. Reasonable allocation of power is realized.

The present invention further includes a heating structure, the LEDs are green LEDs, the heating structure includes a thermal conductive substrate and a chip resistor arranged on the thermal conductive substrate, the radiator is provided with circuit board mounting pits and a heating structure mounting hole which communicate with each other, the thermal conductive substrate is mounted in the heating structure mounting hole, thermal conductive bowls penetrating the circuit board mounting pits are integrally formed on the thermal conductive substrate, and the circuit board is connected into the thermal conductive bowls; the thermal conductive bowls abut against the circuit board mounting pits at the temperature of more than 25° C., and the linear expansion coefficient of the radiator is smaller than that of the thermal conductive bowls.

The requirement of the green LEDs for environmental temperature is particularly high, and the brightness of the green LEDs is reduced when the environmental temperature is less than 25° C. and also reduced when the environmental temperature is more than 30° C., so when the green LEDs are used, both of heat dissipation and heating should be considered; particularly, when the green LEDs are used in winter, the environmental temperature is relatively low and is nearly −25° C. in some countries, and a product using the green LEDs does not light at all; at present, LEDs are heated by two methods, wherein in one method, a heating tape is wound on LEDs and then the LEDs are mounted on the radiator and heated, and this heating method may result in poor LED heat dissipation when heat dissipation is needed and is thus seriously not suitable for heating the LEDs. In the other method, a power resistor is placed on the surface of the LED radiator to heat the radiator, and then the radiator transfers heat to the LEDs, wherein the time for transferring the dissipated heat on the surface of the radiator to the green LEDs to start them is very long, the starting time length (i.e., the time length for heating the LEDs to more than 25° C. to emit light normally) in a low-temperature environment is more than 30 minutes at least, that is, the heating efficiency is low, so green LEDs cannot be used for the existing spot lamp based on the above reasons.

In this technical solution, the original power resistor is substituted into a chip resistor, the chip resistor is attached to the thermal conductive substrate, the heat of the chip resistor is transferred to the thermal conductive bowls, the LEDs need to be heated when the temperature is less than 25° C., at the moment, the circuit board mounting pits are in clearance fit with the thermal conductive bowls under the action of cold contraction, which can effectively prevent the heat of the LEDs from being further lost to achieve the effect of improving the heating efficiency, so that the generated heat can be quickly transferred to the circuit board to heat the LEDs. When the temperature rises, the circuit board mounting pits are in tight fit with the thermal conductive bowls under the action of thermal expansion to conduct heat well, so that the heat dissipation effect is good. The thermal conductive effect between the LEDs and the radiator can be automatically reduced during heating and automatically improved during heat dissipation.

Preferably, the side of the thermal conductive substrate away from the circuit board mounting pits is disconnected from the wall of the heating structure mounting hole. Most of the heat during heating can flow to the thermal conductive bowls to improve the heating effect but block heat dissipation little.

Preferably, the chip resistor is arranged on the side of the thermal conductive substrate away from the circuit board mounting pits. It can ensure that the heat of the chip resistor is transferred to the thermal conductive substrate, and the heat transfer effect between the thermal conductive substrate and the circuit board is not disturbed in the presence of the chip resistor.

Preferably, the thermal conductive bowl is connected with the radiator together in a sealed manner via an annular liquid storage bag, a seal cavity is formed among the thermal conductive bowl, the radiator and the annular liquid storage bag, the seal cavity communicates with the annular liquid storage bag, and heat insulation liquid in the annular liquid storage bag can flow into the seal cavity under elastic contraction of the annular liquid storage bag. When the temperature is less than 25° C., clearances are produced between the thermal conductive bowls and the circuit board mounting pits under the action of cold contraction to reduce the thermal conductive effect between the thermal conductive bowls and the radiator so as to improve the heating effect, and the heat insulation liquid is filled into the clearances at the moment to further improve the heat insulation effect, so that the heating effect is better. When heat dissipation is needed at the temperature of more than 25° C. or 30° C., the thermal conductive bowls abut against the circuit board mounting pits under the action of thermal expansion, and the heat insulation liquid between the thermal conductive bowls and the circuit board mounting pits is extruded out in the abutting process and stored in the annular liquid storage bags. The heating effect during heating can be further improved.

The present invention has the following advantages: light can also be emitted from the back, and generation of a dark zone can be avoided on the back of the spot lamp in use.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

Figure 1:
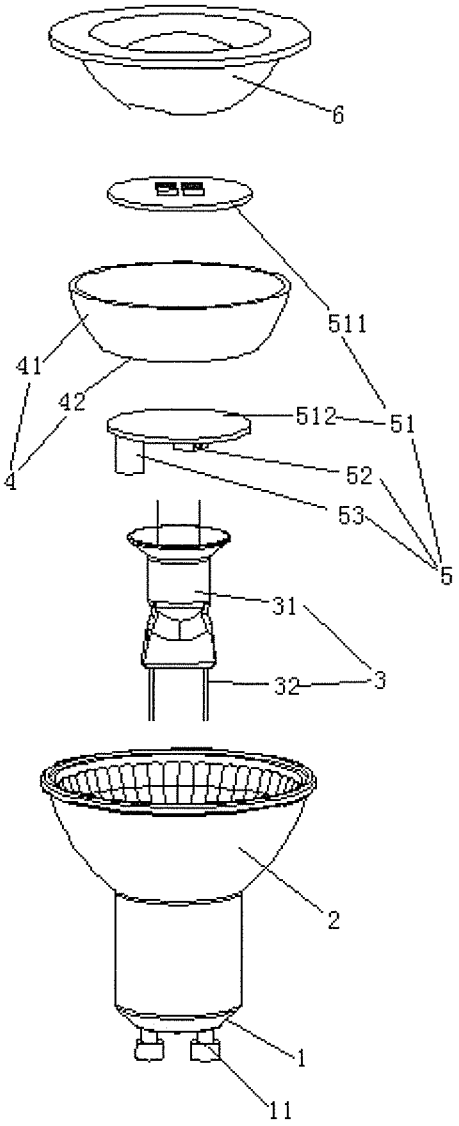
FIG. 1 is an exploded view of embodiment I of the present invention.

In which: lamp cap 1, pin 11, electric wire plugging hole 12, lamp cup 2, wick column 3, shell 31, wick wire 32, radiator 4, cylindrical side wall 41, bottom wall 42, circuit board mounting pit 421, heating structure mounting hole 422, LED light source 5, circuit board 51, main light emitting plate 511, auxiliary light emitting plate 512, LED 52, LED driver 53, lens 6, condensing pit 61, heating structure 7, thermal conductive substrate 71, chip resistor 72, thermal insulation adhesive 73, thermal conductive bowl 74, annular liquid storage bag 75, seal cavity 76.

DESCRIPTION OF THE EMBODIMENTS

The present invention will be further described below in combination with the accompanying drawings and embodiments.

Referring to FIG. 1, an LED spot lamp with double sides emitting light includes a lamp cap 1, a lamp cup 2, a wick column 3, a radiator 4, an LED light source 5 and a lens 6.

The lamp cap 1 is provided with two pins 11.

The lamp cup 2 is of a glass structure, i.e., a light transmitting structure that can transmit light.

The wick column 3 includes a shell 31 and wick wires 32. The shell 31 is of a glass structure, i.e., a light transmitting structure that can transmit light. Two wick wires 32 are provided. The wick wires 32 are of bare structures, i.e., bare wires. The wick wires 32 penetrate through two threading holes of the shell 31 in one-to-one correspondence.

The radiator 4 includes a cylindrical side wall 41 and a bottom wall 42 connected to the end of the cylindrical side wall 41 away from the lens 6. The cylindrical side wall 41 and the bottom wall 42 form a bowl-shaped structure.

The LED light source 5 includes a circuit board 51 provided with a plurality of LEDs 52 and an LED driver 53 for driving the LEDs 52 to emit light. The circuit board 51 includes a main light emitting plate 511 and an auxiliary light emitting plate 512. The LEDs 52 are arranged on both the main light emitting plate 511 and the auxiliary light emitting plate 512 to emit light. The LED driver 53 is arranged on the auxiliary light emitting plate 512.

Figure 2:
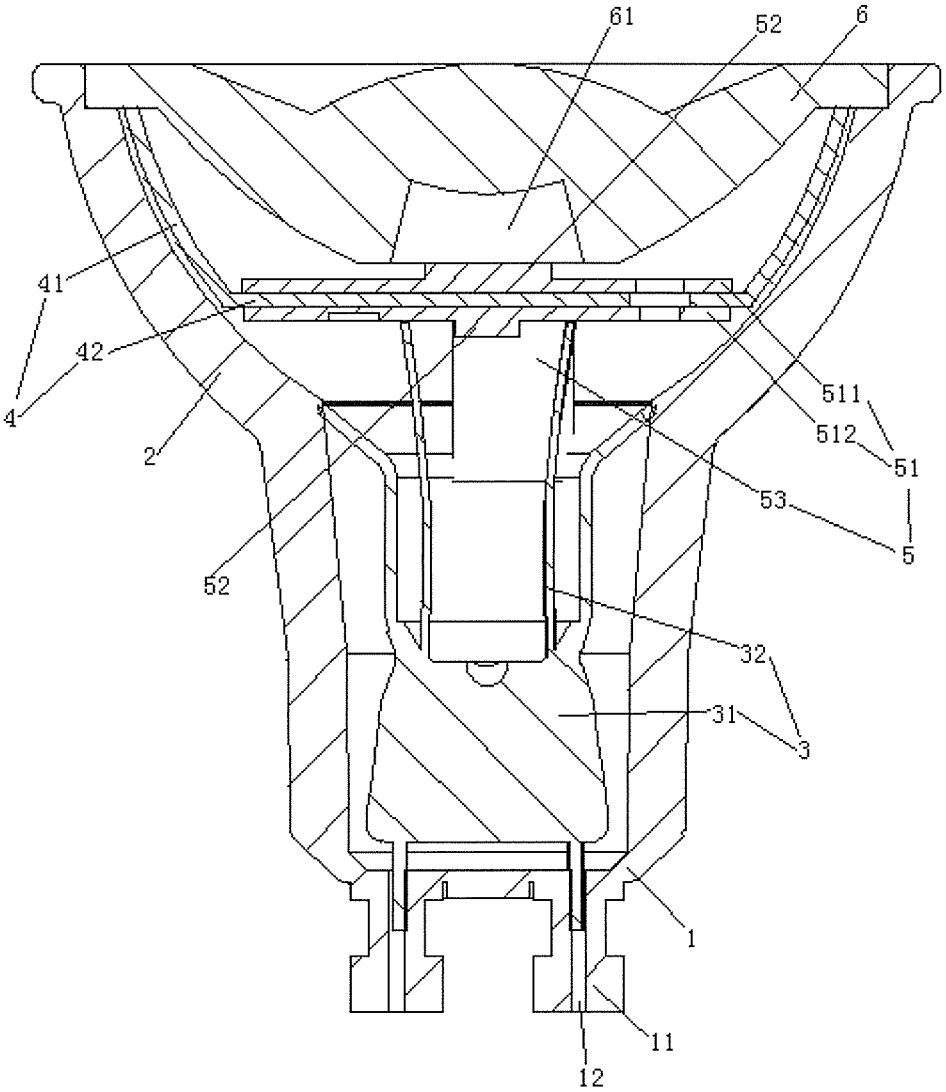
FIG. 2 is a schematic section view of embodiment I of the present invention.

Referring to FIG. 2, a method for assembling the present invention is: each pin 11 is provided with an electric wire plugging hole 12. The lens 6 is provided with a condensing pit 61 on the surface facing the radiator 4.

One end of each wick wire 32 is inserted into the auxiliary light emitting plate 512 to realize electrical connection with the LED driver 53. The auxiliary light emitting plate 512 is horizontally placed on the surface of one side of the bottom wall 42 facing the lamp cap 1. The main light emitting plate 511 is horizontally placed on the surface of the other side of the bottom wall 42 facing the lens 6. The main light emitting plate 511 and the auxiliary light emitting plate 512 are clamped together by such a way that a clamping head is matched with a clamping hole. After being clamped, the main light emitting plate 511 and the auxiliary light emitting plate 512 are clamped on the bottom wall 42 together.

The shell 31 is fixed with the lamp cup 2 together. One end of each wick wire 32 is plugged into the electric wire plugging hole 12 and connected with the pin 11 together, and the lamp cap 1 is connected with one end of the lamp cup 2 together. Thus, the lamp cap 1 introduces power to the LED driver 53. The cylindrical side wall 41 is bonded with the lamp cup 2 together in a thermal conductive manner via a thermal conductive adhesive.

The lens 6 is fixed at the other end of the lamp cup 2. The condensing pit 61 is aligned with the LEDs 52 on the main light emitting plate 511.

After assembly, the lens 6 and the lamp cup 2 form a cavity. The wick column 3, the radiator 4 and the LED light source 5 are all located in the cavity. Light emitted from the main light emitting plate 511 irradiates the lens 6, and is condensed by the condensing pit 61 and then emitted out. Light emitted from the auxiliary light emitting plate 512 irradiates the direction away from the lens 6 and transmits the lamp cup 2 to carry out auxiliary lighting on the rear area of the present invention. The brightness of light emitted from the main light emitting plate 511 is greater than that of light emitted from the auxiliary light emitting plate 512.

Power is introduced to the LED driver 53 by the pins 11 to drive the LEDs 52 to emit light. The heat generated by the LEDs 52 is dissipated by the radiator 4.

Figure 3:
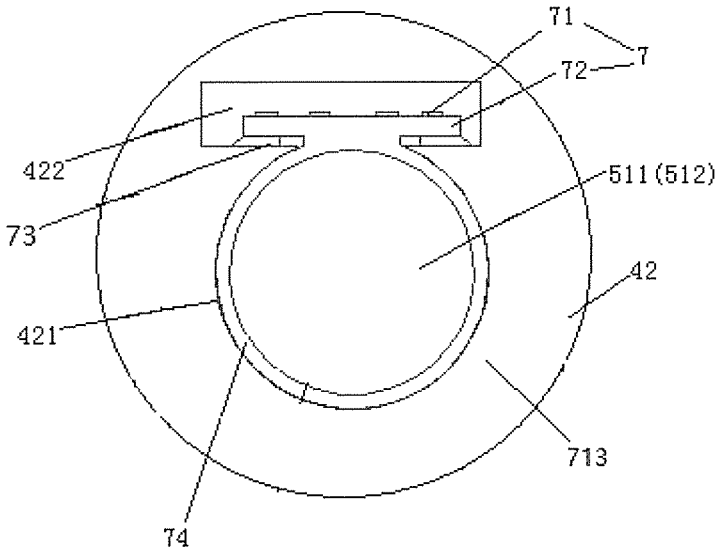
FIG. 3 is a schematic diagram of a connection relation of a circuit board and a radiator in embodiment II.

Embodiment II, different from embodiment I in that:

Referring to FIG. 3, a heating structure 7 is further included.

The front and back surfaces of the bottom wall 42 of the radiator are each provided with a circuit board mounting pit 421. The bottom wall 42 of the radiator is further provided with a heating structure mounting hole 422. The circuit board mounting pits 421 are circular. The heating structure mounting hole 422 is a rectangular hole. The circuit board mounting pits 421 communicate with the heating structure mounting hole 422, specifically in an intersecting manner that the circles where the circuit board mounting pits 421 are located stretch into the heating structure mounting hole 422. The extending directions (i.e., the depth direction) of the circuit board mounting pits 421 and the heating structure mounting hole 422 are the same, and the both extend in the thickness direction of the bottom wall 42.

Both the main light emitting plate 511 and the auxiliary light emitting plate 512 are disc-shaped.

The heating structure 7 includes a thermal conductive substrate 71 and a chip resistor 72 arranged on the thermal conductive substrate 71. The thermal conductive substrate 71 is bonded into the heating structure mounting hole 422 in a horizontal placing manner via a thermal insulation adhesive 73. The side of the thermal conductive substrate 71 away from the circuit board 41 is disconnected from the wall of the heating structure mounting hole 422. The chip resistor 72 is arranged on the side of the thermal conductive substrate 71 away from the circuit board 41. The thermal conductive substrate 71 is provided with two thermal conductive bowls 74. The thermal conductive substrate 71 and the thermal conductive bowls 74 are formed integrally. The two thermal conductive bowls 74 penetrate the two circuit board mounting pits 421 in one-to-one correspondence. The main light emitting plate 511 and the auxiliary light emitting plate 512 penetrate the two thermal conductive bowls 74 in one-to-one correspondence and are connected with the same in a thermal conduction manner so as to be suspended in the two circuit board mounting pits 421. The linear expansion coefficient of the thermal conductive bowls 74 is greater than that of the bottom wall 42, i.e., the external dimension variation produced by the thermal conductive bowls 74 during thermal expansion and cold contraction is greater than that produced by the circuit board mounting pits 421. When the temperature is more than 25° C., the thermal conductive bowls 74 abut against the circuit board mounting pits 421 to realize indirect abutting of the circuit board 741 and the circuit board mounting pits 421.

During use, when the temperature of the circuit board 741 is more than 25° C., power is not supplied to the heating structure 7, i.e., not electrify the chip resistor 72, the enlarged external dimension of the thermal conductive bowls 74 is greater than that of the circuit board mounting pits 421, so that the thermal conductive bowls 74 abut against the circuit board mounting pits 421 more closely to conduct heat better. The heat generated by the main light emitting plate 511 and the auxiliary light emitting plate 512 is transferred to the radiator via the corresponding thermal conductive bowls 74 and dissipated. When the temperatures of the main light emitting plate 511 and the auxiliary light emitting plate 512 are less than 25° C., the chip resistor 72 is electrified, the heat generated by the chip resistor 72 is transferred to the thermal conductive substrate 71 and transferred to the main light emitting plate 511 and the auxiliary light emitting plate 512 via the thermal conductive bowls 74 to heat the LEDs on the circuit board to the temperature not less than 25° C.; when the temperature is less than 25° C., the reduced external dimension of the thermal conductive bowls 74 is greater than that of the circuit board mounting pits 421, so that clearances are produced between the thermal conductive bowls 74 and the circuit board mounting pits 421 to reduce heat transfer from the thermal conductive bowls 74 to the radiator, and the heat transferred from the thermal conductive bowls 74 can be transferred to the circuit board more sufficiently to improve the heating effect.

Figure 4:
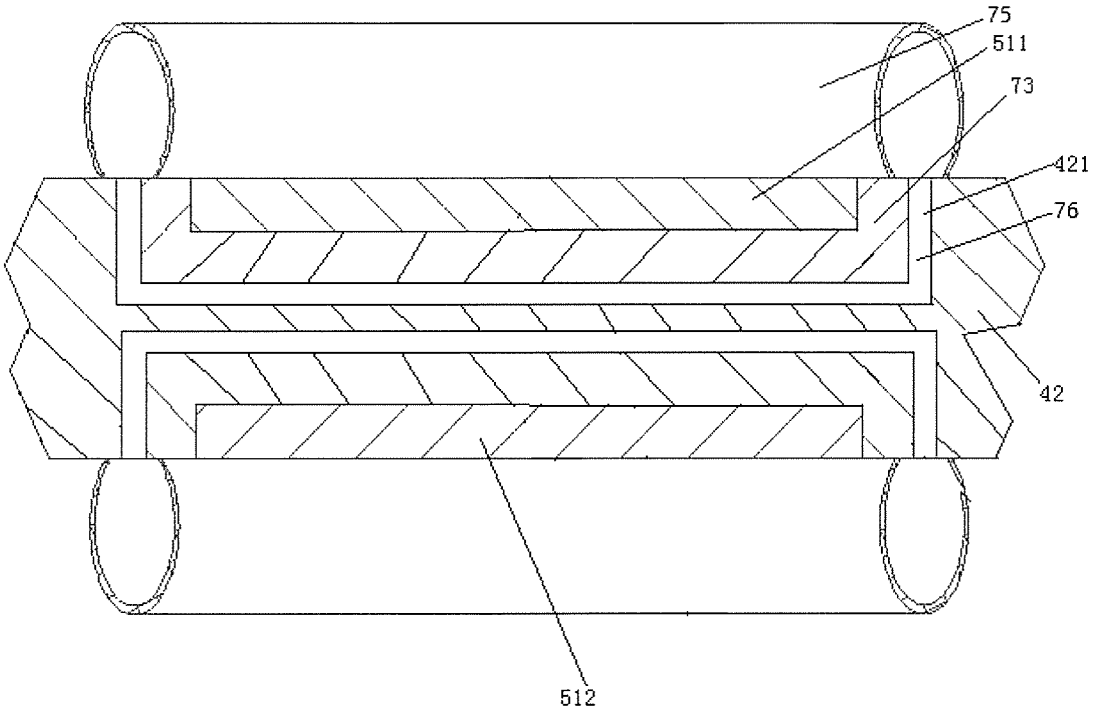
FIG. 4 is a partial schematic diagram of embodiment III.

Embodiment III, different from embodiment II in that:

Referring to FIG. 4, the thermal conductive bowls 74 (as shown in FIG. 3) are connected with the bottom wall 42 together in a sealed manner via annular liquid storage bags 75. The annular liquid storage bags 75 are filled with heat insulation liquid, which keeps the annular liquid storage bags 75 in an elastic expansion state. When the temperature is less than 25° C., a seal cavity 76 is formed among the thermal conductive bowl 74, the bottom wall 42 and the annular liquid storage bag 75. The seal cavity 76 communicates with the annular liquid storage bag 75.

When the temperature is less than 25° C., clearances are produced between the thermal conductive bowls 74 and the circuit board mounting pits 421 under the action of cold contraction so that the seal cavities 76 appear, at the moment, the heat insulation liquid in the annular liquid storage bags 75 flows into the seal cavities 76 under elastic contraction of the annular liquid storage bags 75, to further reduce the quantity of heat transferred from the thermal conductive bowls 74 to the bottom wall 42, so that the heating effect is further improved. When heat dissipation is needed at the temperature of more than 25° C. or 30° C., the thermal conductive bowls 74 abut against the circuit board mounting pits 421 under the action of thermal expansion so that the seal cavities 76 disappear, and the heat insulation liquid in the seal cavities 76 is re-extruded back to the annular liquid storage bags 75 and stored.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An LED spot lamp with double sides emitting light, comprising:

a lamp cap;

a lamp cup with one end connected with the lamp cap together;

a lens connected to the other end of the lamp cup, wherein a cavity is encircled by the lamp cup and the lens;

an LED light source arranged in the cavity and comprising a circuit board provided with a plurality of LEDs and an LED driver for driving the LEDs to emit light; and a radiator arranged in the cavity and used for supporting the circuit board and dissipating a heat generated by the LEDs;

wherein the circuit board comprises a main light emitting plate and an auxiliary light emitting plate, the main light emitting plate irradiates the lens, the auxiliary light emitting plate irradiates the direction away from the lens, the lamp cup is of a light transmitting glass structure, and the brightness of light emitted from the main light emitting plate is greater than that of light emitted from the auxiliary light emitting plate.

2. The LED spot lamp with double sides emitting light according to claim 1, wherein a wick column is further arranged in the cavity, the wick column comprises a glass shell and wick wires arranged in the glass shell in a penetrating manner and having bare structures, the glass shell is connected with the lamp cap or the lamp cup together, one end of the wick wires is electrically connected with the lamp cap, and the other end of the wick wires is connected with the circuit board to introduce power to the LED driver.

3. The LED spot lamp with double sides emitting light according to claim 2, wherein the wick wires are connected with the circuit board in a pluggable manner.

4. The LED spot lamp with double sides emitting light according to claim 3, wherein the radiator comprises a cylindrical side wall and a bottom wall connected to the end of the cylindrical side wall away from the lens, the main light emitting plate is arranged on the surface of one side of the bottom wall facing the lens, and the auxiliary light emitting plate is located on the surface of the other side of the bottom wall away from the lens.

5. The LED spot lamp with double sides emitting light according to claim 3, wherein the LED driver is arranged on the circuit board.

6. The LED spot lamp with double sides emitting light according to claim 3, further comprising a heating structure, wherein the LEDs are green LEDs, the heating structure comprises a thermal conductive substrate and a chip resistor arranged on the thermal conductive substrate, the radiator is provided with circuit board mounting pits and a heating structure mounting hole which communicate with each other, the thermal conductive substrate is mounted in the heating structure mounting hole, thermal conductive bowls penetrating the circuit board mounting pits are integrally formed on the thermal conductive substrate, and the circuit board is connected into the thermal conductive bowls; the thermal conductive bowls abut against the circuit board mounting pits at the temperature of more than 25° C., and the linear expansion coefficient of the radiator is smaller than that of the thermal conductive bowls.

7. The LED spot lamp with double sides emitting light according to claim 2, wherein the radiator comprises a cylindrical side wall and a bottom wall connected to the end of the cylindrical side wall away from the lens, the main light emitting plate is arranged on the surface of one side of the bottom wall facing the lens, and the auxiliary light emitting plate is located on the surface of the other side of the bottom wall away from the lens.

8. The LED spot lamp with double sides emitting light according to claim 2, wherein the LED driver is arranged on the circuit board.

9. The LED spot lamp with double sides emitting light according to claim 2, further comprising a heating structure, wherein the LEDs are green LEDs, the heating structure comprises a thermal conductive substrate and a chip resistor arranged on the thermal conductive substrate, the radiator is provided with circuit board mounting pits and a heating structure mounting hole which communicate with each other, the thermal conductive substrate is mounted in the heating structure mounting hole, thermal conductive bowls penetrating the circuit board mounting pits are integrally formed on the thermal conductive substrate, and the circuit board is connected into the thermal conductive bowls; the thermal conductive bowls abut against the circuit board mounting pits at the temperature of more than 25° C., and the linear expansion coefficient of e radiator is smaller than that of the thermal conductive bowls.

10. The LED spot lamp with double sides emitting light according to claim 1, wherein the radiator comprises a cylindrical side wall and a bottom wall connected to the end of the cylindrical side wall away from the lens, the main light emitting plate is arranged on the surface of one side of the bottom wall facing the lens, and the auxiliary light emitting plate is located on the surface of the other side of the bottom wall away from the lens.

11. The LED spot lamp with double sides emitting light according to claim 10, wherein the main light emitting plate and the auxiliary light emitting plate are clamped together and held on the cylindrical side wall.

12. The LED spot lamp with double sides emitting light according to claim 10, wherein the cylindrical side wall is bonded with the lamp cup together via a thermal conductive adhesive.

13. The LED spot lamp with double sides emitting light according to claim wherein the LED driver is arranged on the circuit board.

14. The LED spot lamp with double sides emitting light according to claim 13, wherein the LED driver is arranged on the auxiliary light emitting plate.

15. The LED spot lamp with double sides emitting light according to claim 1, further comprising a heating structure, wherein the LEDs are green LEDs, the heating structure comprises a thermal conductive substrate and a chip resistor arranged on the thermal conductive substrate, the radiator is provided with circuit board mounting pits and a heating structure mounting hole which communicate with each other, the thermal conductive substrate is mounted in the heating structure mounting hole, thermal conductive bowls penetrating the circuit board mounting pits are integrally formed on the thermal conductive substrate, and the circuit board is connected into the thermal conductive bowls; the thermal conductive bowls abut against the circuit board mounting pits at the temperature of more than 25° C., and the linear expansion coefficient of the radiator is smaller than that of the thermal conductive bowls.

16. The LED spot lamp with double sides emitting light according to claim 15, wherein the thermal conductive bowls are connected with the radiator together in a sealed manner via an annular liquid storage bag, a seal cavity is formed among the thermal conductive bowls, the radiator and the annular liquid storage bag, the seal cavity communicates with the annular liquid storage bag, and a heat insulation liquid in the annular liquid storage bag flows into the seal cavity under elastic contraction of the annular liquid storage bag.

* * * * *